US007083205B2

(12) United States Patent
Hall

(10) Patent No.: US 7,083,205 B2
(45) Date of Patent: Aug. 1, 2006

(54) DOUBLE-ACTING LOAD FLOOR SLAM LATCH

(75) Inventor: Matthew Hall, Worcester (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/664,220

(22) Filed: Sep. 17, 2003

(65) Prior Publication Data

US 2004/0113432 A1 Jun. 17, 2004

Related U.S. Application Data

(60) Provisional application No. 60/411,321, filed on Sep. 17, 2002.

(51) Int. Cl.
*E05C 9/10* (2006.01)

(52) U.S. Cl. ..... 292/34; 292/175

(58) Field of Classification Search ..... 292/32–34, 292/37, 40, 175
See application file for complete search history.

(56) References Cited

U.S. PATENT DOCUMENTS

| | | | | |
|---|---|---|---|---|
| 1,580,666 | A * | 4/1926 | Hansen | 292/128 |
| 2,186,903 | A | 1/1940 | Gleason | |
| 2,640,720 | A * | 6/1953 | Brown | 292/150 |
| 2,649,322 | A | 8/1953 | Mack | |
| 3,494,650 | A | 2/1970 | Slopa | |
| 3,495,862 | A | 2/1970 | McClintock | |
| 3,743,336 | A | 7/1973 | Andrews | 292/173 |
| 3,782,141 | A | 1/1974 | Doerrfeld | 70/146 |
| 3,936,084 | A * | 2/1976 | Orr | 292/169.15 |
| 4,138,869 | A | 2/1979 | Pelcin | 70/151 R |
| 4,321,812 | A | 3/1982 | Pelcin | 70/472 |
| 4,322,958 | A | 4/1982 | Eigemeier | 70/107 |
| 4,330,145 | A * | 5/1982 | Bisbing | 292/37 |
| 4,335,595 | A | 6/1982 | Swan et al. | 70/149 |
| 4,438,964 | A | 3/1984 | Peters | 292/216 |
| 4,492,396 | A | 1/1985 | Luke et al. | 292/228 |
| 4,650,230 | A | 3/1987 | Takasaki | 292/173 |
| 4,683,736 | A | 8/1987 | Weinerman et al. | 70/208 |
| 4,687,237 | A | 8/1987 | Bisbing | 292/78 |
| 4,704,882 | A | 11/1987 | Takasaki | 70/215 |
| 4,906,044 | A * | 3/1990 | Wilstermann | 297/188.15 |
| 4,969,916 | A | 11/1990 | Weinerman et al. | 70/208 |
| 5,149,152 | A * | 9/1992 | Lanius | 292/37 |
| 5,292,159 | A | 3/1994 | Sandhu et al. | 292/173 |
| 5,413,391 | A | 5/1995 | Clavin et al. | 292/170 |
| 5,484,178 | A | 1/1996 | Sandhu et al. | 292/173 |
| 5,820,175 | A | 10/1998 | Clavin | 292/165 |
| 5,878,608 | A | 3/1999 | Alyanakian | 70/208 |
| 5,927,773 | A | 7/1999 | Larsen et al. | 292/337 |
| 6,023,953 | A | 2/2000 | Vickers et al. | 70/208 |
| 6,152,501 | A | 11/2000 | Magi et al. | 292/336.3 |

(Continued)

FOREIGN PATENT DOCUMENTS

| | | |
|---|---|---|
| WO | WO 200448870 | 8/2000 |

*Primary Examiner*—Gary Estremsky
(74) *Attorney, Agent, or Firm*—Paul & Paul

(57) ABSTRACT

The present invention relates to a latch for securing together a panel to a keeper thus permitting opening and closing of a portion of the panel while allowing the remaining portion of the panel to remain closed. When the latch is unlatched from a keeper, a user can refasten the panel by lowering the panel until the main pawl and the keeper are fastened together by the action of the keeper on the pawl of the latch. The latch also provides for the opening and closing of a portion of one of the panels while allowing the remaining portion of that panel to remain closed.

14 Claims, 13 Drawing Sheets

U.S. PATENT DOCUMENTS

| | | | | |
|---|---|---|---|---|
| 6,203,077 | B1 | 3/2001 | Schlack | 292/203 |
| 6,266,981 | B1 * | 7/2001 | von Resch et al. | 70/107 |
| 6,409,234 | B1 | 6/2002 | Larsen et al. | 292/173 |
| 6,626,472 | B1 | 9/2003 | Berg | 292/336.3 |
| 6,631,931 | B1 * | 10/2003 | Magnusson | 292/175 |
| 6,719,332 | B1 | 4/2004 | Sekulovic | 292/170 |
| 2005/0093304 | A1 | 5/2005 | Figge et al. | 292/173 |

* cited by examiner 20
3

3

3

3

20
3

3

FIG. 32
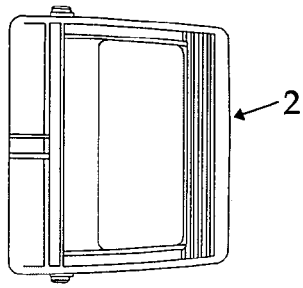
FIG. 33
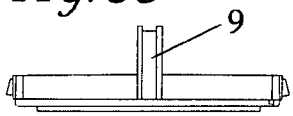
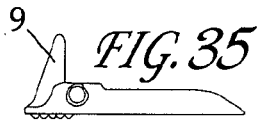
FIG. 35
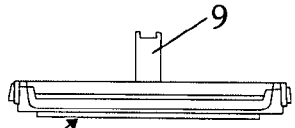
FIG. 34
FIG. 31
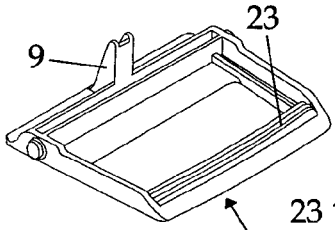
FIG. 30
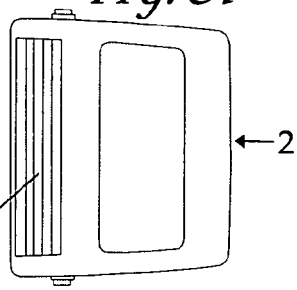

FIG. 45
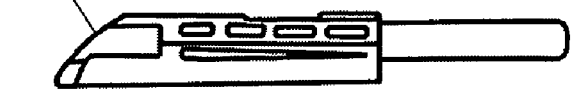
FIG. 46
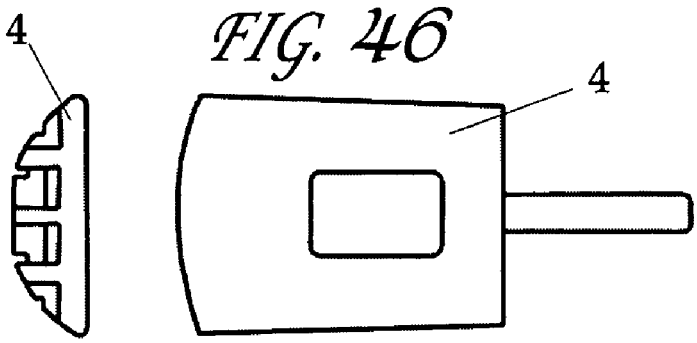
FIG. 43
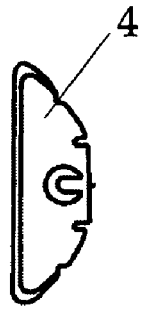
FIG. 47
FIG. 44
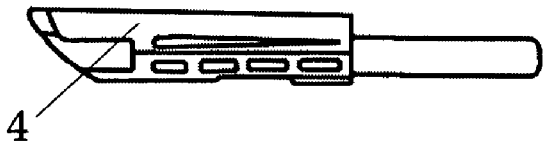
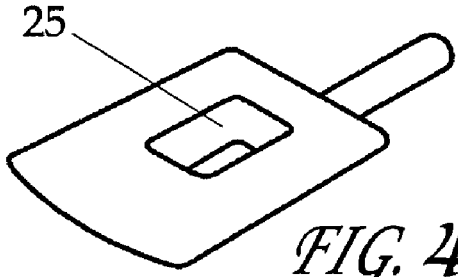
FIG. 42

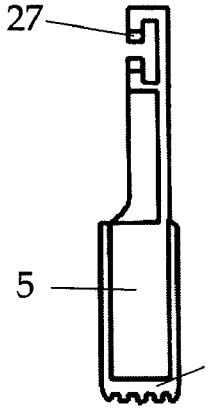
FIG. 48
FIG. 51
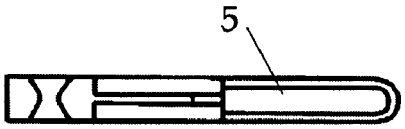
FIG. 49
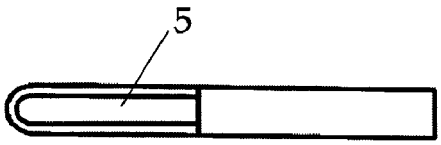
FIG. 50
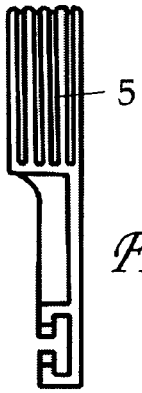
FIG. 53
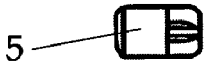
FIG. 52

DOUBLE-ACTING LOAD FLOOR SLAM LATCH

CROSS-REFERENCE TO RELATED APPLICATIONS

This application claims the benefit under 35 U.S.C. 119(e) of U.S. provisional patent application No. 60/411,321 filed Sep. 17, 2002 entitled Double Acting Load Floor Slam Latch the entire specification of which is incorporated by reference.

BACKGROUND OF THE INVENTION

The present invention relates to a latch for securing together a panel in a frame to a keeper and provides for the opening and closing of a portion of the panel while allowing the remaining portion of the panel to remain closed. The latch can be repeatedly latched and unlatched by a user who desires to fasten and unfasten the entire panel or a portion of the panel which is adjacent the keeper.

Various latches are known for securing a panel to a keeper. One drawback with the previous latches is that the latches did not provide for the ability to secure only a portion of a panel in a frame and therefore provide the user with the ability to open and close only a portion of the panel which is divided into portions.

A need exists for a latch which can provide an improvement over the prior art in that it will be less costly to produce and less time-consuming to assemble, as well as providing slam-action latching ability when a portion of the panel is unfastened from a frame and the main pawl is in the closed position.

A further need exists for a latch which can be slammed shut to close from an open state when the panel is not fastened to the keeper by the latch.

In addition, load floor latches, which is one application for the latches of the present invention, are commonly used in the automotive industry. Often, these latches are employed to secure the contents of a compartment in a cargo area. The latch of the present invention can be used in compartments and bins in various locations such as glove compartments and storage areas in vehicles. For example, load floor latches find use for securing a floor panel, such as the panel which regulates access to vehicle items, such as spare tires, tools, jacks, batteries, and the like. In many cases, the floor panel is provided on the floor of a passenger vehicle or cargo compartment. The latch therefore must be durable, and it is desirable that the latch be able to withstand substantial force loads, such as those of the type generally encountered by bumps, rough terrain, and especially vehicular accidents, such as crashes, or rollover situations. It is important that compartment contents remain secured in the event of a vehicle crash or rollover. This is especially more important where the cargo compartment is located in the same general area as the vehicle operator, or other passengers. For example, in station wagon type vehicles, the cargo space for passengers and items of cargo is the same. Thus, in this type of vehicle, there is great danger to be encountered should a rollover of the vehicle occur and the latch becomes unsecured. If this were to happen, the compartment contents would spill out into the passenger compartment, thereby placing the vehicle operator in danger. A need exists for a load floor latch which has improved abilities to withstand a rollover, and facilitate latching of a panel, even under high stress conditions. It is also important that the latch, in addition to being durable, be easy to construct and install.

SUMMARY OF THE INVENTION

The present invention is directed to a latch for securing a panel in a frame to a keeper and provides for the opening and closing of a portion of the panel while allowing the remaining portion of that panel to remain closed. A user can open the entire panel or a predetermined portion of the panel. The panel can be a door or load floor panel and the keeper can be provided in a vehicle subframe.

In accordance with the present invention, it is an object to provide a latch for securing together a panel to a keeper thus permitting opening and closing of a portion of the panel while allowing the remaining portion of the panel to remain closed.

When the latch is unlatched from a keeper, a user can refasten the panel by lowering the panel until the main pawl and the keeper are fastened together by the action of the keeper on the pawl of the latch. The latch also provides for the opening and closing of a portion of one of the panels while allowing the remaining portion of that panel to remain closed.

The present invention in one embodiment comprises a housing, a handle and a rocker mounted in the housing, a main pawl, a secondary side pawl and a main pawl spring. The main pawl of the latch is configured to be positioned in a panel and thereby secure the panel in a frame. The main pawl extends through the frame and when the latch is in the closed position, the main pawl is secured to the keeper. The secondary side pawl is provided such that it secures only a portion of the panel to the frame. To place the entire panel in an open position, the secondary side pawl is placed into a locked and closed position and the secondary side pawl engages the frame. To open only a defined portion of the panel the secondary side pawl must be in the open position such that the secondary side pawl clears the frame when that portion of the panel is opened. To open either the entire panel or only a portion of the panel, the handle is opened by a user and the handle actuates the main pawl and releases the panel from the load floor. A biasing means provides a biasing force on the main pawl such that when the user desires that the panel be closed such that the main pawl engages the keeper and the panel is secured, the panel can be lowered and a force applied to an outer face of the panel causes the main pawl to contact the keeper. A linear force on the pawl results in the direction of the rear of the housing and the main pawl slides back into the housing. The main pawl can now move back into a position such that the main pawl fastens the panel in a closed position. The handle can be provided with a biasing means in order to minimize undesired movement of the handle which may cause rattling when the handle is in an at rest position.

The inwardly facing side of the rocker is provided with two plungers each of which is inside a tower. The plungers compress back into the towers due to interference with a detent device on the inside of the housing which the plungers face. This creates a detent effect similar to that of a light switch and provides for an open and a closed position of the rocker. A user can rotate the rocker which in turn activates the secondary side pawl.

Another object of the invention is to provide a latch which allows a panel to be fastened by a slam action. This is accomplished by the shape of the pawl which interacts with the keeper.

Another object of the present invention is to accomplish the above objects by providing a spring-biased latch which can be closed by slam-action.

Another object of the present invention is to provide a latch which can be used in connection with panels of vehicles to regulate access to and from an area or compartment, such as, for example, a floor panel and a floor storage compartment.

Another object of the present invention is to provide a latch which has improved retention characteristics under stress forces, such as those experienced by vehicle rollovers and crashes.

These and other objects of the present invention will be more readily apparent when taken into consideration with the following description and the attached drawings.

BRIEF DESCRIPTION OF THE DRAWINGS

FIG. 30 is a perspective view of the bottom of a handle of the latch of FIG. 1 showing an actuator.

FIG. 31 is a top view of the handle of the latch of FIG. 1.

FIG. 32 is a view of the bottom of the handle of the latch of FIG. 1 showing an actuator.

FIG. 33 is a front view of the handle of the latch of FIG. 1.

FIG. 34 is a rear view of the handle of the latch of FIG. 1.

FIG. 35 is a side view of the handle of the latch of FIG. 1.

FIG. 42 is a perspective view of the top of the main pawl of the latch of FIG. 1.

FIG. 43 is a top view of the main pawl of the latch of FIG. 1.

FIG. 44 is a side view of the main pawl of the latch of FIG. 1.

FIG. 45 is a side view of the main pawl of the latch of FIG. 1.

FIG. 46 is a top view of the main pawl of the latch of FIG. 1.

FIG. 47 is a rear view of the main pawl of the latch of FIG. 1.

FIG. 48 is a top view of the secondary side pawl of the latch of FIG. 1.

FIG. 49 is a side view of the secondary side pawl of the latch of FIG. 1.

FIG. 50 is a side view of the secondary side pawl of the latch of FIG. 1.

FIG. 51 is a front view of the secondary side pawl of the latch of FIG. 1.

FIG. 52 is a rear view of the secondary side pawl of the latch of FIG. 1.

FIG. 53 is a bottom view of the secondary side pawl of the latch of FIG. 1.

DETAILED DESCRIPTION OF THE INVENTION

Figure 1:
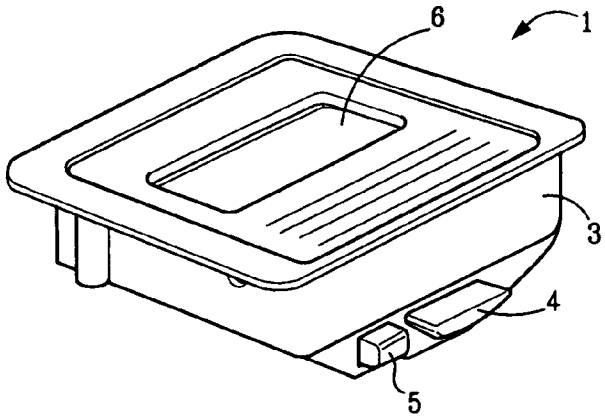
FIG. 1 is a perspective view of a preferred embodiment of a latch in accordance with the present invention showing the main pawl and secondary side pawl in the closed position.
Figure 3:
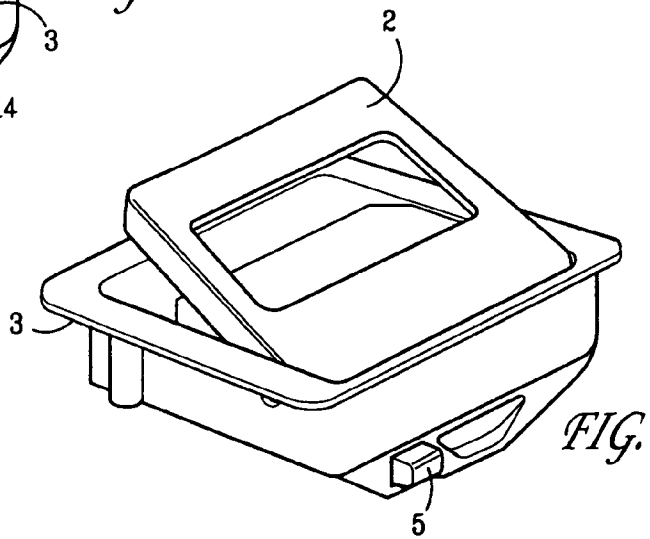
FIG. 3 is a perspective view of the latch of FIG. 1 showing actuation of the main pawl.
Figure 2:
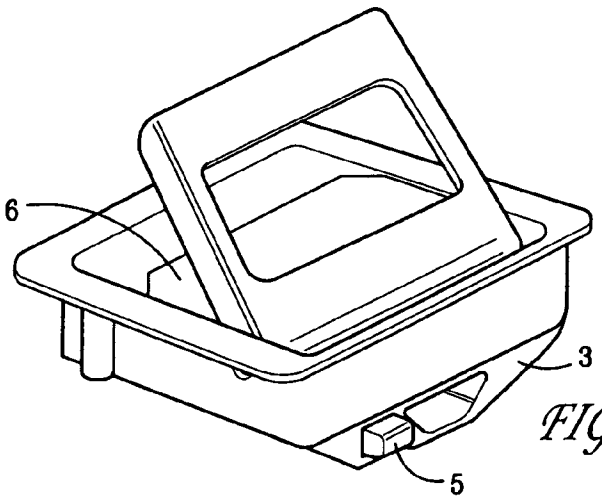
FIG. 2 is a perspective view of the latch of FIG. 1 with the main pawl in the open position.
Figure 4:
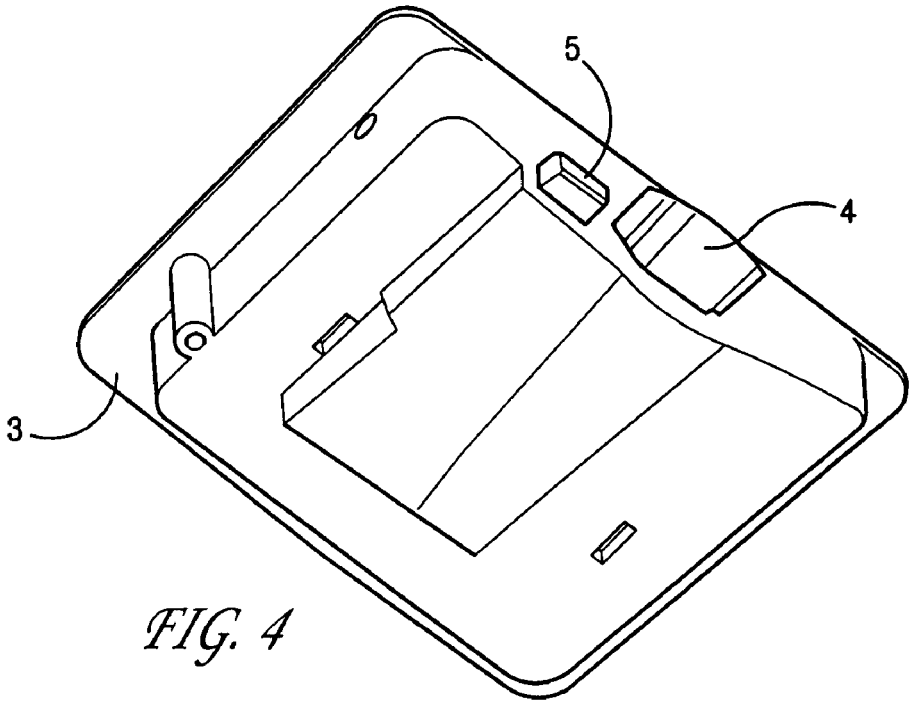
FIG. 4 is a perspective view of the bottom of the latch of FIG. 1 showing the main pawl and secondary side pawl in the closed position.

Referring now to the drawings in detail wherein like reference numerals indicate like elements through the several views, there is shown in FIG. 1–4, perspective views of a preferred embodiment of a latch 1 in accordance with the present invention with a housing 3, handle 2 and rocker 6. FIGS. 2 and 3 show the actuation of the main pawl 4 during rotation of handle 3. As the handle 2 is rotated from the rest position shown in FIG. 1, the main pawl 4 moves toward the rear of the housing 3 thereby placing the main pawl 4 in the open position so that the main pawl 4 no longer protrudes from the housing 3 as shown in FIG. 2. Secondary side pawl 5 is shown protruding from housing 3 in the closed position in FIGS. 1–4.

Figure 7:
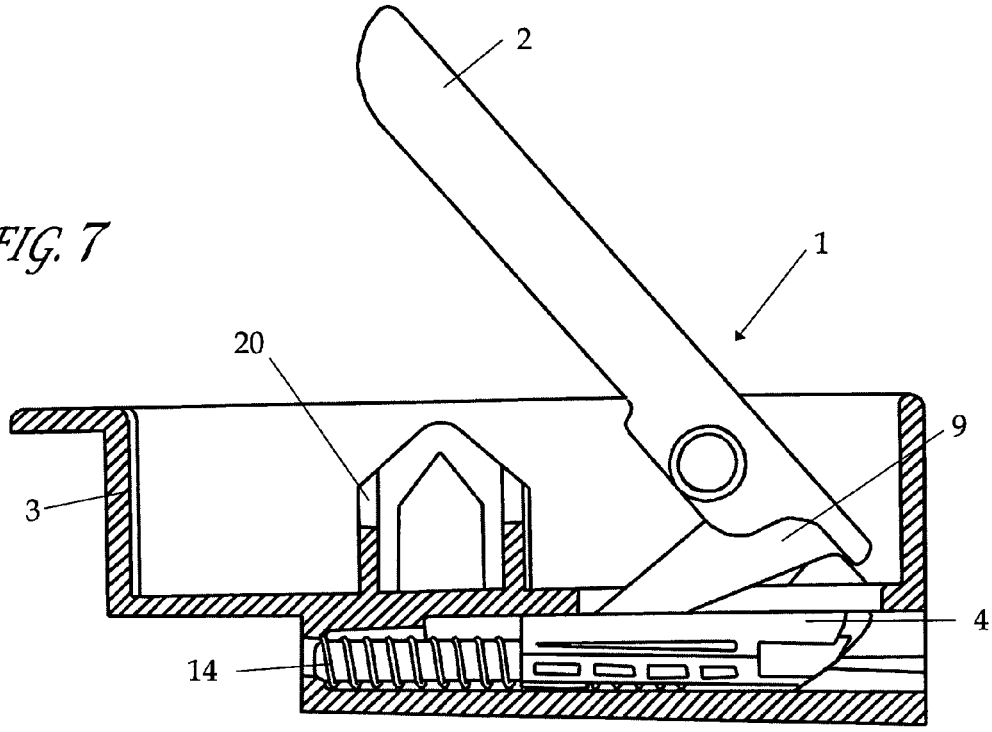
FIG. 7 is a sectional view of a side of the latch of FIG. 1 showing the main pawl in the open position.
Figure 8:
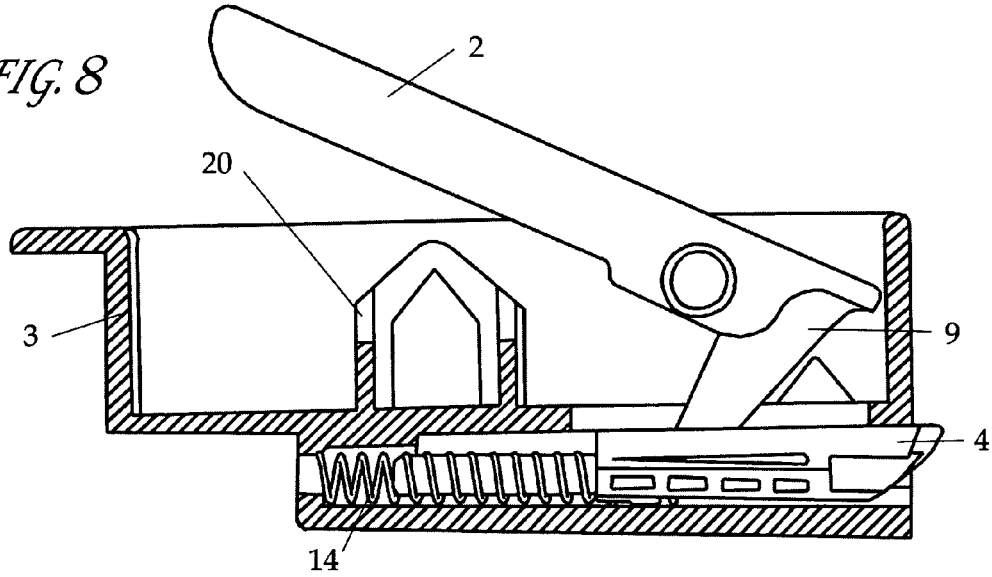
FIG. 8 is a sectional view of a side of the latch of FIG. 1 showing the main pawl during actuation of the main pawl.
Figure 9:
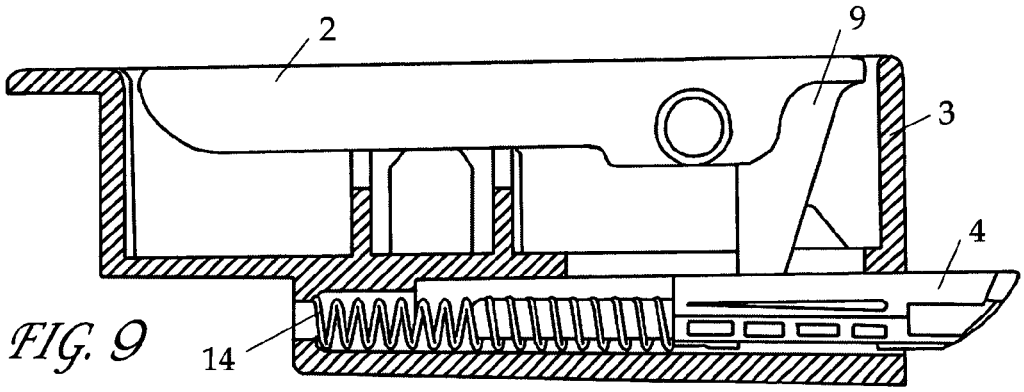
FIG. 9 is a sectional view of a side of the latch of FIG. 1 showing the main pawl in the closed position.
Figure 10:
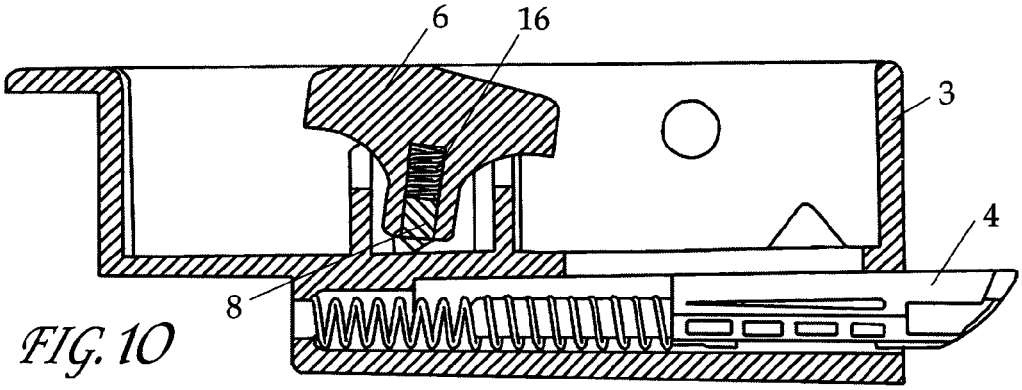
FIG. 10 is a sectional view of a side of the latch of FIG. 1 showing the rocker when the secondary pawl is in the open position.
Figure 11:
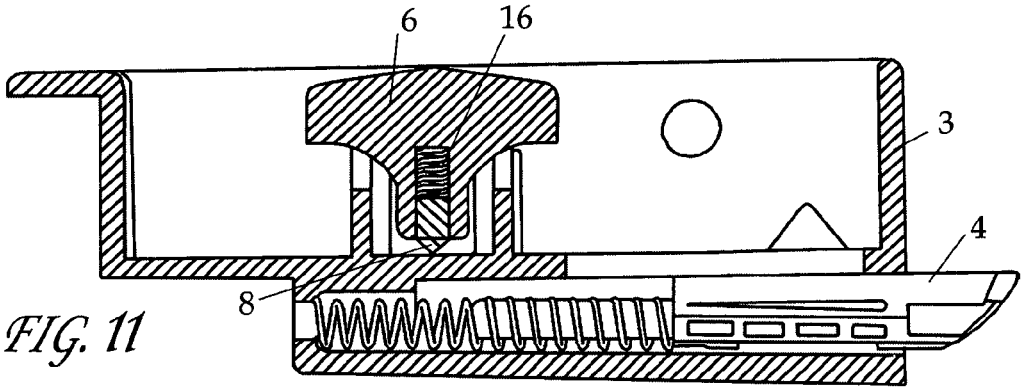
FIG. 11 is a sectional view of a side of the latch of FIG. 1 showing the rocker during actuation of the secondary side pawl.
Figure 12:
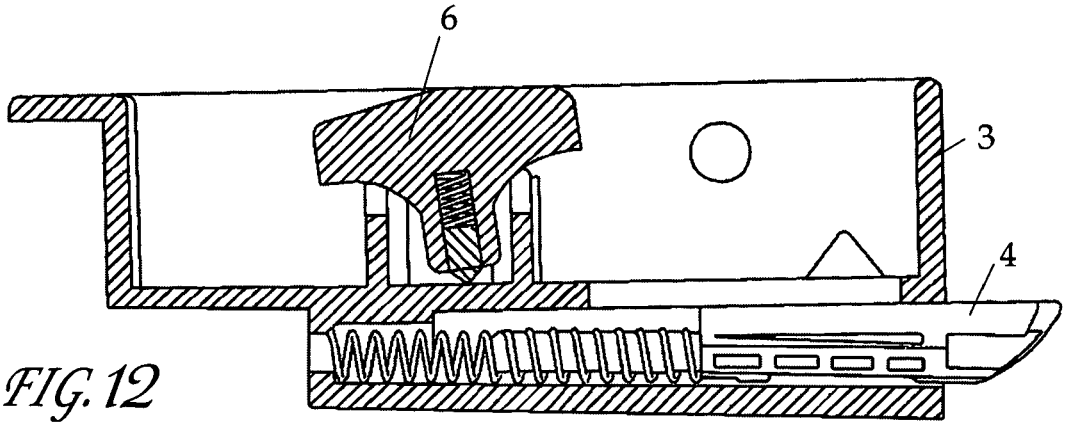
FIG. 12 is a sectional view of a side of the latch of FIG. 1 showing the rocker when the secondary side pawl is in the closed position.
Figure 13:
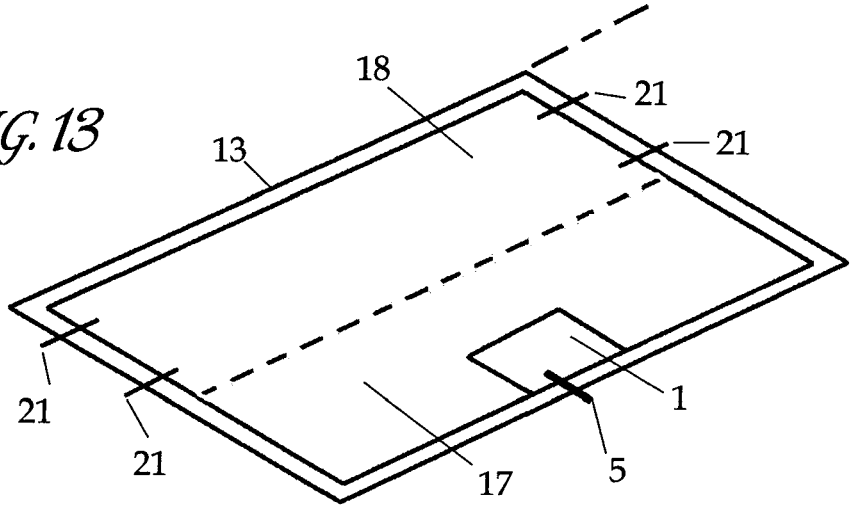
FIG. 13 is a perspective view of the latch of FIG. 1 provided in a front portion of a panel in a frame wherein the front portion and rear portion of the panel are closed.

FIGS. 7–9 show the handle 2 of the latch 1. The handle 2 features a handle actuator 9 which pivots or rotates with the handle 2 and contacts an interior face 25 of the main pawl 4. As the main pawl 4 is pushed toward the rear of the housing 3 during movement of the handle 2 the main pawl 4 can be biased against a biasing means. The biasing means can be a spiral spring 14 mounted on a projection on a rear wall of the housing 3.

Figure 15:
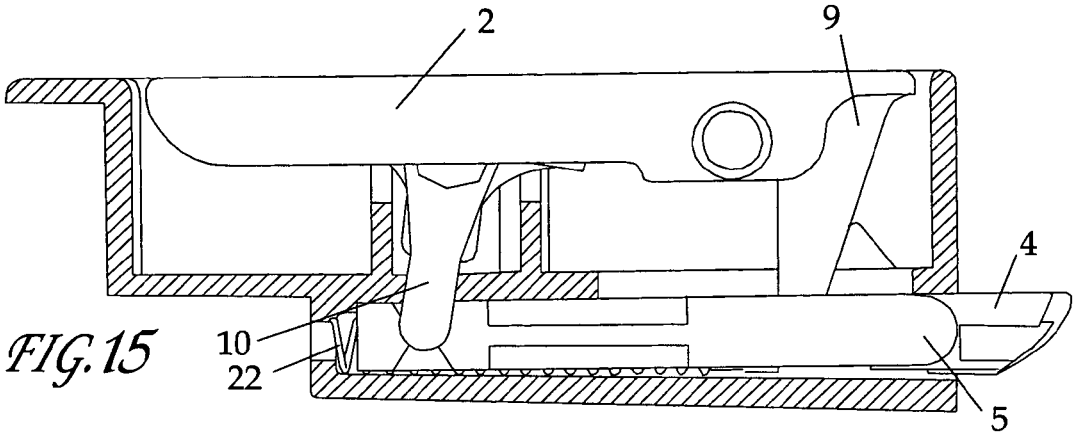
FIG. 15 is a sectional view of a side of the latch of FIG. 1 showing the rocker when the secondary pawl is in the open position.
Figure 16:
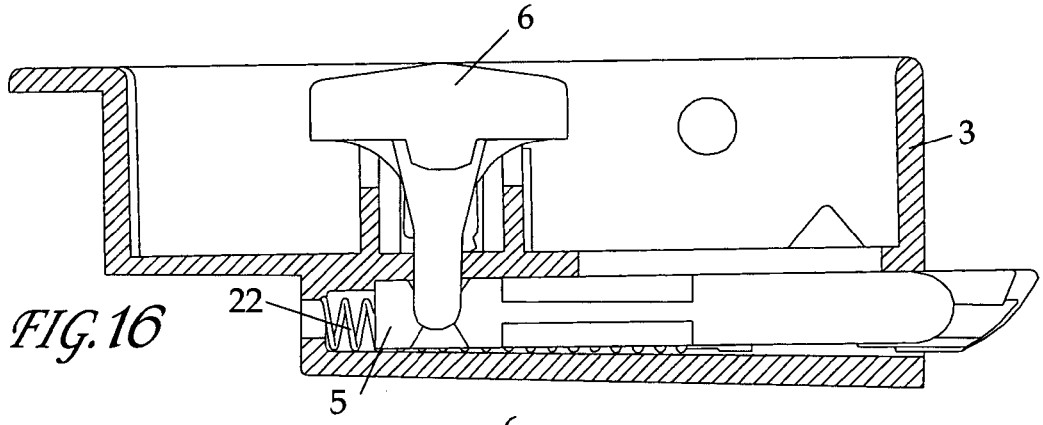
FIG. 16 is a sectional view of a side of the latch of FIG. 1 showing the rocker during actuation of the secondary side pawl.
Figure 17:
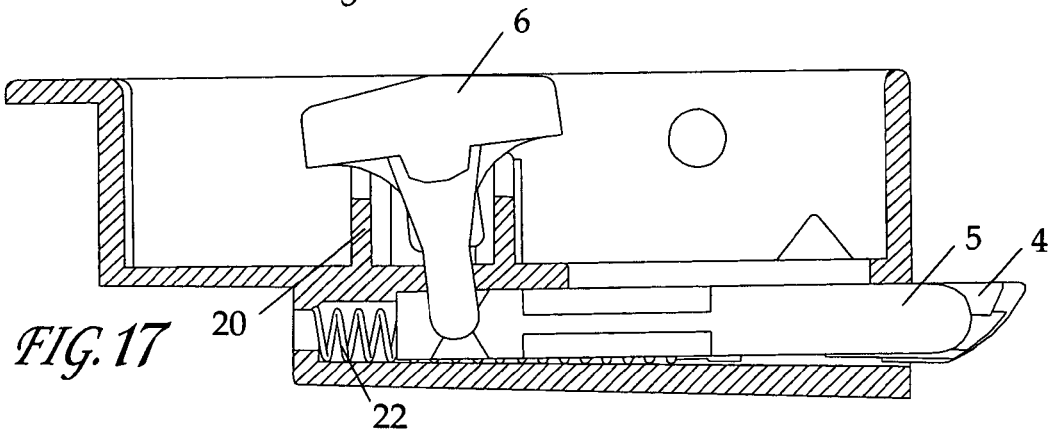
FIG. 17 is a sectional view of a side of the latch of FIG. 1 showing the rocker when the secondary side pawl is in the closed position.
Figure 18:
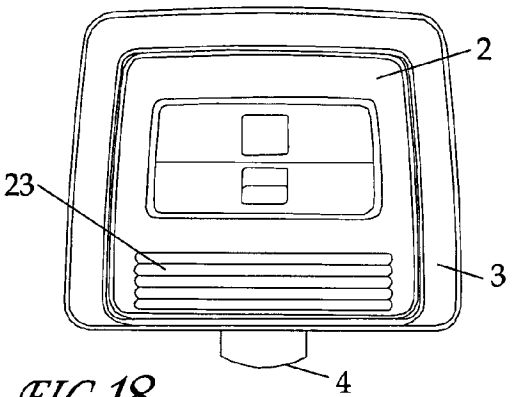
FIG. 18 is a top view of the latch of FIG. 1 showing the main pawl in the closed position.
Figure 19:
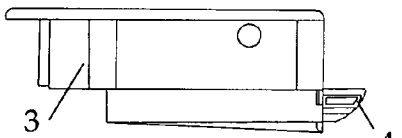
FIG. 19 is a side view of the latch of FIG. 1 showing the main pawl in the closed position.
Figure 20:
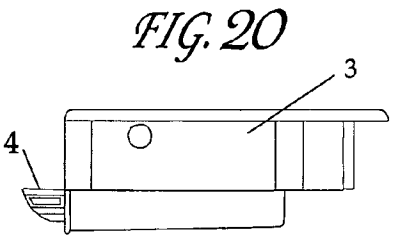
FIG. 20 is a side view of the latch of FIG. 1 showing the main pawl in the closed position.
Figure 21:
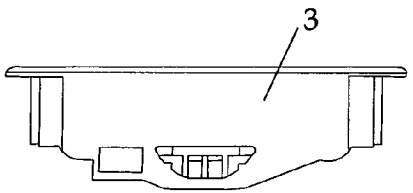
FIG. 21 is a front view of the latch of FIG. 1 showing the main pawl in the closed position.
Figure 22:
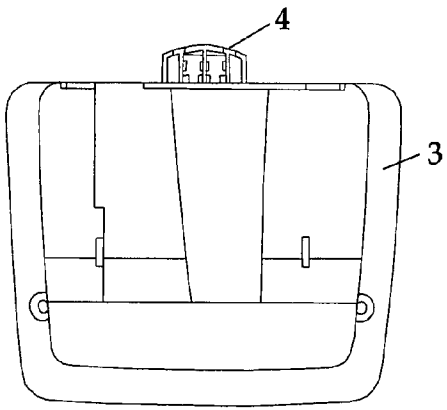
FIG. 22 is a top view of the latch of FIG. 1 showing the main pawl in the closed position.
Figure 23:
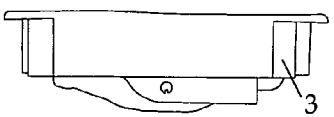
FIG. 23 is a rear view of the latch of FIG. 1 showing the main pawl in the closed position.
Figures 24, 25, 26, 27, 28, 29:
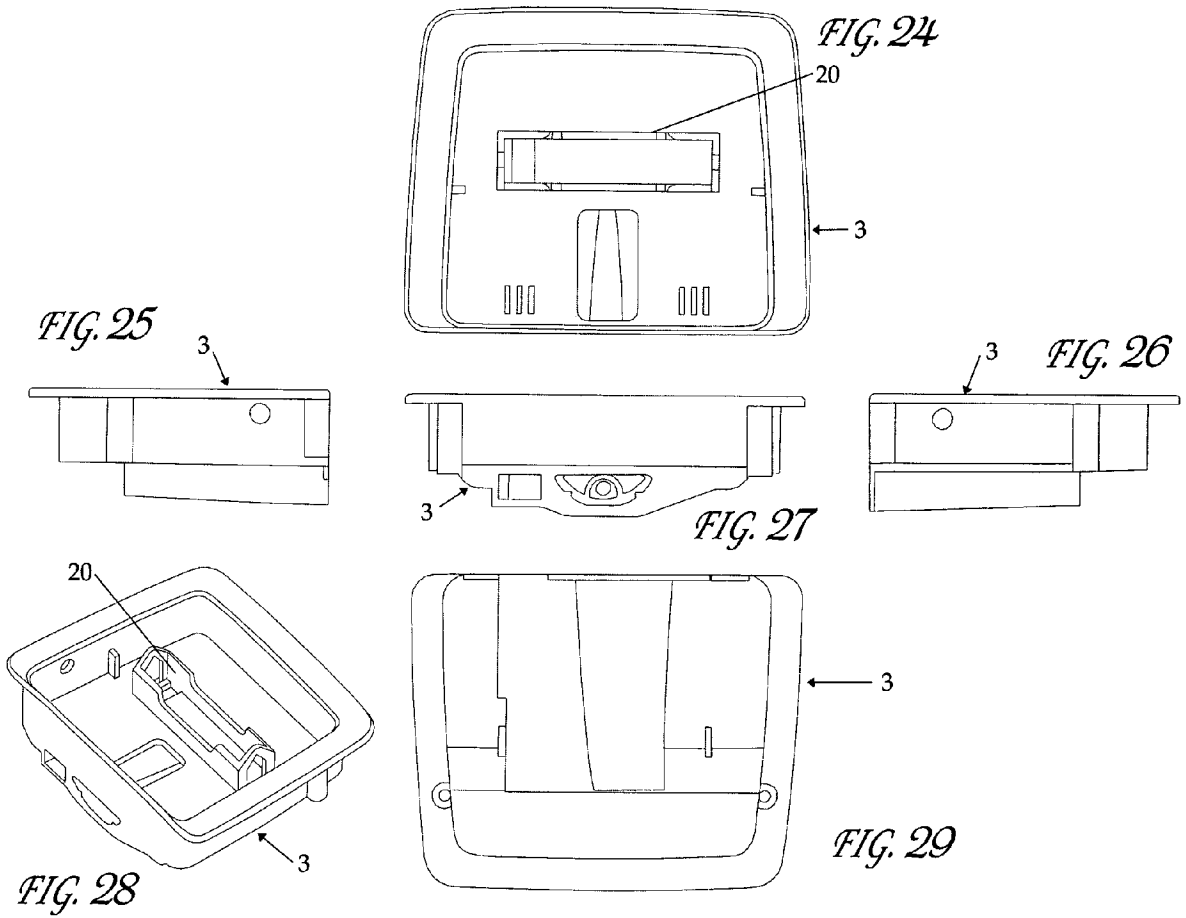
FIG. 24 is a top view of the housing of the latch of FIG. 1.
FIG. 25 is a side view of the housing of the latch of FIG. 1.
FIG. 26 is a side view of the housing of the latch of FIG. 1.
FIG. 27 is a rear view of the housing of the latch of FIG. 1.
FIG. 28 is a perspective view of the top of the housing of the latch of FIG. 1.
FIG. 29 is a view of the bottom of the housing of the latch of FIG. 1.
Figure 37:
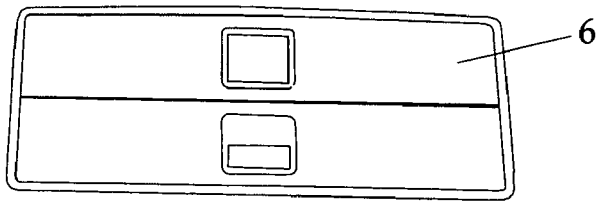
FIG. 37 is a top view of the rocker of the latch of FIG. 1.
Figure 38:
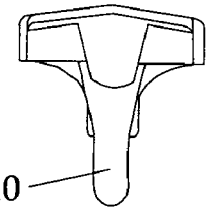
FIG. 38 is a side view of the rocker of the latch of FIG. 1.
Figure 40:
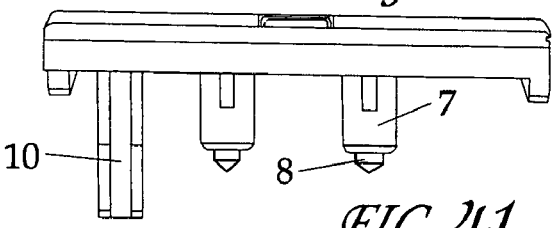
FIG. 40 is a front view of the rocker of the latch of FIG. 1.
Figure 39:
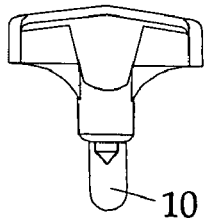
FIG. 39 is a side view of the rocker of the latch of FIG. 1.
Figure 41:
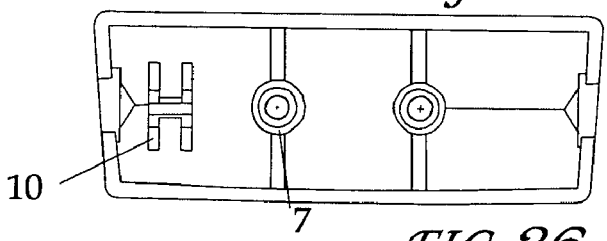
FIG. 41 is a bottom view of the rocker of the latch of FIG. 1.
Figure 36:
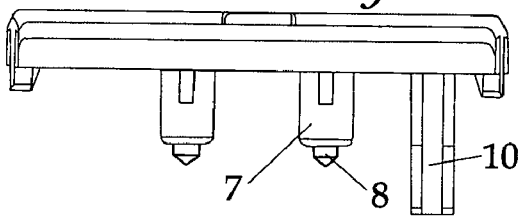
FIG. 36 is a rear view of the rocker of the latch of FIG. 1.

FIGS. 10–12 and 15–17 show a rocker 6 of a preferred embodiment of the latch 1 of the present invention. The rocker 6 has two towers 7 each having a plunger 8. The plungers 8 extend from the towers 7 and can move in the longitudinal direction of the towers 7. A biasing force provided by a biasing device in the towers 7 is applied to the plungers 8. As shown, a plunger spring 16 is the biasing device. The rocker 6 also has a rocker actuator 10 which acts upon secondary side pawl 5. Rocker actuator 11 acts upon interior face 27 of the secondary side pawl 5 during movement of rocker actuator 10 as shown in FIGS. 15–17.

Figure 5:
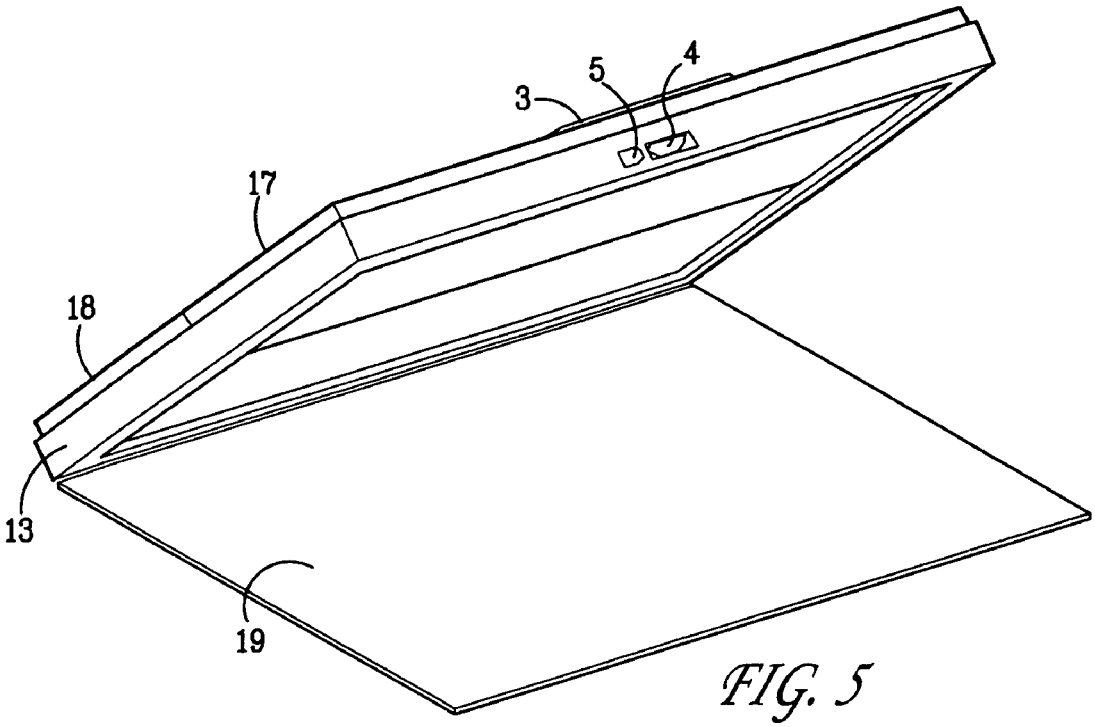
FIG. 5 is a perspective view of a latch of FIG. 1 provided in a front portion of a panel in a frame wherein the front portion and rear portion of the panel are open.
Figure 6:
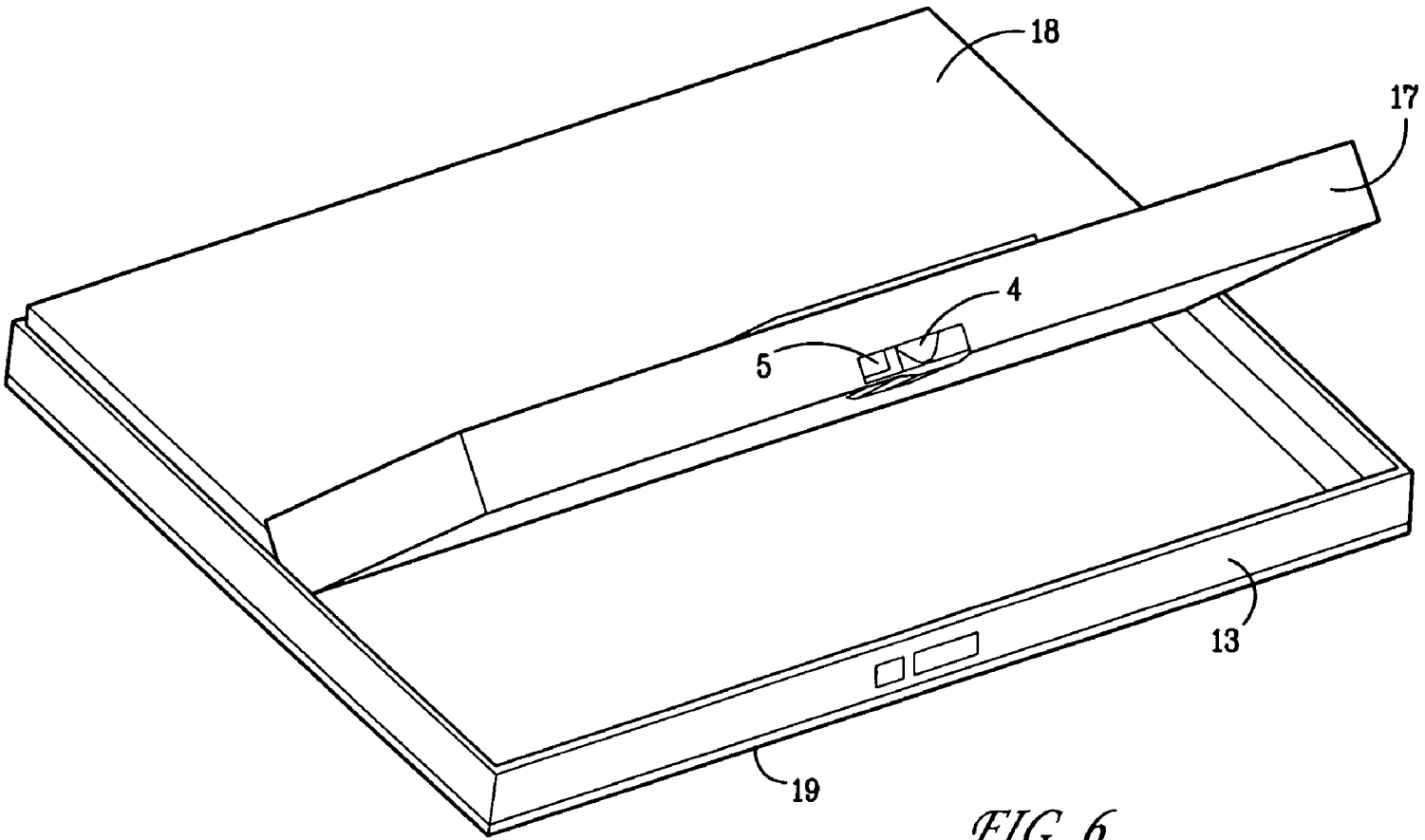
FIG. 6 is a perspective view of a latch of FIG. 1 provided in a front portion of a panel in a frame wherein only the front portion of the panel is open.
Figure 14:
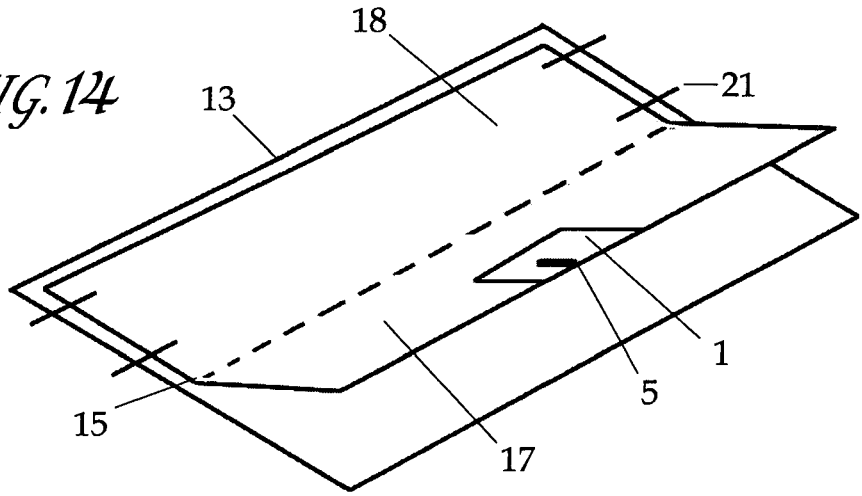
FIG. 14 is a perspective view of the latch of FIG. 1 provided in a front portion of a panel in a frame wherein the front portion of the panel is closed.

Through the action of the main pawl 4, the main pawl 4 can secure the panel 12 as a whole to the frame 13 as shown in FIG. 5 wherein access to a closure area 19 is obtained by the opening of the whole panel 12. The secondary side pawl 5 is shown in FIG. 5 securing one half of the panel 12 to the frame 13 which is in turn supported by the main pawl 4. The exterior face 26 of secondary side pawl 5 need not project entirely through the frame 13 in order to secure the panel front portion 17. The panel rear portion 18 does not move due to the fixing device 21 which affixes panel rear portion 18 permanently to the frame 13. Panel front portion 17 is free to move to an open position as shown in FIG. 6 by pivoting movement at hinge 15 as shown in FIG. 14.

To open the panel 12 as a whole the secondary side pawl 5 has to be in the locked and closed position. To open half of the panel 12 the secondary side pawl 5 has to be in the open position. Actuation in both cases is facilitated by opening the handle 2 which actuates the main pawl 4 and releases the panel 12.

The following is a description of the unfastening of the panel 12 as a whole by disengagement of the main pawl 4 of the latch 1 from the keeper as shown in FIG. 5. With the panel 12 and the latch 1 in the closed position, the user can press the front of the closed handle 2 which can have a ribbed area 23 to assist in the gripping of the handle 2 to rotate the rear of the handle 2 up as to allow finger access. The user's hand can then be inserted into the handle 2 and it is rotated to its full extension. The handle actuator 9 hidden under the handle 2 acts in a rotational manner upon the handle 2 being rotated, contacting an interior face 25 of the main pawl 4, creating a linear force to the rear of the latch 1, sliding the main pawl 4 back into the housing 3 and compressing the main pawl spring 14. The secondary side pawl 5 is still locked in the closed position securing the panel front portion 17 of the panel to the frame 13 which can be metal allowing the panel 12 and frame 13 to be opened as a whole. The main pawl 4 is now free from the keeper (not shown) which can be an internal subframe of a car which allows the panel 12 in the form of a loadfloor in the vehicle to be lifted and opened as a whole.

To close the panel 12 as a whole when the panel 12 is opened as a whole, the user must lower the panel 12 and press on a face of the panel 12 to actuate the 'push to close' main pawl design. Upon an exterior face 24 of the main pawl 4 contacting the keeper a linear force is created in the direction of the rear of the latch 1. This forces the main pawl 4 back into the housing 3, compressing the main pawl spring 14, independently from the handle actuator 9. Upon the panel 12 moving into the closed position the compressed main pawl spring 14 forces the main pawl 4 back out of the housing 3 to lock into the keeper which can be an internal metal subframe of a vehicle. The panel 12 as a whole is now locked in the closed position.

As shown in FIGS. 6 and 14, to open the panel front portion 17 independently of the panel rear portion 18 as shown in FIGS. 6 and 14, when the main pawl 4 and secondary side pawl 5 of the latch 1 is in the closed position, the user must press the rocker 6 to an open position thereby actuating the secondary side pawl 5. As shown in FIGS. 10–12 and 15–17, the rocker 6 rotates and a rocker actuator 10 underneath the rocker 6 acts in a rotational manner to contact an interior face 27 of the secondary side pawl, creating a linear force to the rear of the latch 1 sliding the secondary side pawl 5 back into the housing 3. Preferably, full rotation of the rocker 6 occurs in 16 degrees. From the outset of rotation there are two plungers 8, contained within two towers 7 underneath the rocker 6 which compress plungers 8 back into their towers due to interference with the inside of the housing 3 at a detent device 20 which the plungers 8 face. Preferably, full compression of the plungers 8 occurs at the mid point of rotation (8 degrees) and full extension of the plungers 8 occurs at the start and the end of rotation (0 and 16 degrees). This creates a detent effect similar to that of a conventional light switch. This switch effect also creates the detent for the open and closed positions.

After the secondary side pawl 5 is rotated back clear of the frame as described above, the secondary side pawl 5 is now in the open position and is clear of frame 13. To allow the front section of the hinged panel front portion 17 to open independently of the panel rear portion and away from the frame, the user presses the front of the closed handle 2 which can have a ribbed area 23 to rotate the rear of the handle 2 up preferably to allow finger access. The hand is then inserted into the handle 2 and the handle 2 is rotated to its full extension. The handle actuator 9 under the handle 2 acts in a rotational manner upon the handle 2 being rotated, thereby contacting an interior face 25 of the main pawl 4, creating a linear force to the rear of the latch 1, sliding the main pawl 4 back into the housing 3 and compressing the main pawl spring 14. The main pawl 4 is now free from the keeper allowing the panel front portion 17 of the panel 12 to open independently from the panel rear portion 18.

To close the panel front portion 17 from the open position the user must lower the panel front portion 17 and cause a force to act upon a face of the panel front portion 17 to actuate the 'push to close' main pawl design. Upon the main pawl 4 contacting the keeper a linear force is created in the direction of the rear of the latch 1. This forces the main pawl 4 back into the housing 3, compressing the main pawl spring 14, independently from the handle actuator 9. Upon the panel 12 moving into the closed position the compressed main pawl spring 14 forces the main pawl 4 back out of the housing 3 to lock into the keeper (not shown). The panel front portion of the panel is now locked in the closed position.

To lock the panel front portion 17 into the frame 13 the user must press the rocker 6 to the closed position actuating the secondary side pawl 5. The rocker 6 rotates and the rocker actuator 10 underneath the rocker 6 acts upon the rocker actuator 10 in a rotational manner contacting an internal face 27 of the secondary side pawl 5, creating a linear force to the front of the latch 1 and sliding the secondary side pawl 5 back into the frame 13. Preferably, full rotation of the rocker 6 occurs in 16 degrees. From the outset of rotation there are two plungers 8, contained within two towers 7 underneath the rocker 6, that compress back into the towers 7 due to interference with the detent device 20 at the inside of the housing 3 which acts upon the plungers 8. Preferably, full compression of the plungers 8 occurs at the mid point of rotation (8 degrees) and full extension of the plungers 8 occurs at the start and the end of rotation (0 and 16 degrees). This creates the detent to retain the secondary side pawl 5 in the closed position. The panel 12 is now locked in the closed position.

The keeper described above can be a member having an aperture in a vehicle subframe. The frame described above can be metal or plastic not to the exclusion of other materials.

It will be recognized by those skilled in the art that changes may be made by the above-described embodiments of the invention without departing from the broad inventive concepts thereof. For example, each of the features described above do not all need to be included in a single device. Rather, one or more features can be provided in a single device where desired and in any combination. It is understood, therefore, that this invention is not limited to the particular embodiment disclosed, but it is intended to cover all modifications which are within the scope and spirit of the invention.

I claim as my invention:

1. A latch for releasably securing a closure member in a frame to a keeper and for opening a predetermined portion of the closure member, the latch comprising:

a housing adapted for being received in an aperture formed in the closure member;

a main pawl slideable in the housing between an open position and a closed position in which the main pawl is engageable with the keeper;

a handle for moving the main pawl from an open position to a closed position, said handle being pivotally attached to said housing and said handle having a handle actuator which engages the main pawl upon pivoting of the handle between a closed position and an open position, a main pawl biasing device for biasing the main pawl such that said main pawl biasing device biases the main pawl to the closed position;

a secondary pawl slideable in the housing between an open position and a closed position;

a detent device which moves the secondary pawl between an open position and a closed position in which the secondary pawl is engageable with the frame when the detent device is in the closed position, said detent device being pivotally attached to said housing;

whereby pivoting of the detent device to an open position moves the secondary pawl to the open position away from the frame thereby permitting opening of a portion of the closure member when the main pawl is engaged with the keeper or with the frame.

2. A latch for releasably securing a closure member in a frame to a keeper and for opening a predetermined portion of the closure member, the latch comprising:

a housing adapted for being received in an aperture formed in the closure member;

a main pawl slideable in the housing between an open position and a closed position in which the main pawl is engageable with the keeper;

a handle for moving the main pawl from an open position to a closed position, said handle being pivotally attached to said housing, a main pawl biasing device for biasing the main pawl such that said main pawl biasing device biases the main pawl to the closed position;

a secondary pawl slideable in the housing between an open position and a closed position;

a detent device which moves the secondary pawl between an open position and a closed position in which the secondary pawl is engageable with the frame when the detent device is in the closed position, said detent device being pivotally attached to said housing;

wherein the detent device has at least one tower having at least one plunger and a biasing device in the at least one tower which biases the at least one plunger against the housing when the detent device is pivoted;

whereby pivoting of the detent device to an open position moves the secondary pawl to the open position away from the frame thereby permitting opening of a portion of the closure member when the main pawl is engaged with the keeper or with the frame.

3. The latch according to claim 2 wherein the detent device has two towers, each of which has a plunger and a plunger biasing device.

4. The latch according to claim 2 wherein the detent device pivots about 16 degrees from the closed position to the open position and full compression of the at least one plunger occurs at the midpoint of the pivoting of the at least one tower.

5. The latch according to claim 2 wherein the plunger biasing device is a spiral spring.

6. The latch according to claim 2 wherein the detent device has two opposite ends each of which has a projection which fits in a respective recess on the housing.

7. The latch according to claim 2 wherein the secondary pawl has a first end engageable with the frame when the secondary pawl is in the closed position and a second end opposite the first end and wherein the detent device includes a projection which engages the second end of the secondary pawl when the secondary pawl slides between the closed position and the open position.

8. The latch according to claim 1 wherein a face of the main pawl is engageable with the keeper, and the face of the main pawl which is engageable with the keeper is shaped such that the main pawl retracts against the force of the main pawl biasing device so as to permit the closure member to be slammed into a latched position.

9. The latch according to claim 1 further comprising a secondary pawl biasing device for biasing the secondary pawl toward the closed position.

10. The latch according to claim 1 wherein the latch further comprises a handle biasing device which biases the handle to the closed position.

11. The latch according to claim 10 wherein the handle biasing device is a spiral spring.

12. The latch according to claim 1 combination with a vehicle wherein the keeper is on an internal subframe of the vehicle.

13. The combination according to claim 12 wherein the closure member is a door.

14. The combination according to claim 13 wherein the closure member is a load floor of the vehicle.

* * * * *